US006241116B1

(12) United States Patent
Schrepfer et al.

(10) Patent No.: US 6,241,116 B1
(45) Date of Patent: Jun. 5, 2001

(54) METAL CONTAINER CAPABLE OF WITHSTANDING INTERNAL OVER PRESSURE

(75) Inventors: Bernd Schrepfer, Daaden; Hans-Helmut Reichmann, Burbach, both of (DE)

(73) Assignee: Schäfer Werke GmbH, Neunkirchen (DE)

( * ) Notice: Subject to any disclaimer, the term of this patent is extended or adjusted under 35 U.S.C. 154(b) by 0 days.

(21) Appl. No.: 08/513,835

(22) PCT Filed: Feb. 23, 1994

(86) PCT No.: PCT/EP94/00510

§ 371 Date: Sep. 1, 1995

§ 102(e) Date: Sep. 1, 1995

(87) PCT Pub. No.: WO94/20375

PCT Pub. Date: Sep. 15, 1994

(30) Foreign Application Priority Data

Mar. 5, 1993 (DE) ..... 93 03 113 U

(51) Int. Cl.[7] ..... B65D 6/40; B65D 90/36; F17C 1/00

(52) U.S. Cl. ..... 220/581; 220/89.2; 220/601; 220/608; 220/DIG. 1

(58) Field of Search ..... 220/581, 583, 220/585, 601, 609, 624, 4.04, 4.06, 89.2, 260, 604, 608, 89.1, DIG. 1; 222/389, 397; 137/68.19, 68.11

(56) References Cited

U.S. PATENT DOCUMENTS 832,509 * 10/1906 Slocum ..... 220/266
2,307,043 * 1/1943 Hothersall ..... 220/89.2 X
3,292,826 * 12/1966 Abplanalp ..... 220/89.2 X
4,347,942 * 9/1982 Jernberg et al. ..... 220/89.2
4,597,505 * 7/1986 Mozley et al. ..... 220/89.2
4,722,874 * 2/1988 Marchak ..... 220/89.2 X
5,063,958 * 11/1991 Wisneskie et al. ..... 220/89.2 X

FOREIGN PATENT DOCUMENTS 2336889 4/1974 (DE) .
3533406 3/1987 (DE) .
3737977 5/1989 (DE) .

* cited by examiner

*Primary Examiner*—Allan N. Shoap
*Assistant Examiner*—Niki M. Eloshway
(74) *Attorney, Agent, or Firm*—Friedrich Kueffner

(57) ABSTRACT

A container of metal capable of withstanding an internal overpressure includes a hollow vessel for containing contents having an essentially cylindrical side wall and two outwardly curved end walls formed as partial spherical surfaces. At least one of the curved end walls has a central bulge protruding as a cup-shaped bottom from the curved end wall. A container connecting pipe is mounted on the central bulge of the at least one curved end wall. An intended breaking point is integrated in at least one of the partial spherical surfaces formed by one of the end walls, wherein the intended breaking point is a notch formed in an outer side of the end wall, and wherein the notch has varying depths with a maximum depth and a minimum depth. The notch has a geometric configuration whereby the minimum depth is located diametrically opposite the maximum depth and the maximum depth of the notch is located in a portion of the end wall which, when the notch is not present, is subjected to the greatest deformation under the influence of a defined internal pressure which exceeds the permissible operating pressure. The notch is arranged so as to extend transversely of the direction of maximum expansion of the end wall.

4 Claims, 2 Drawing Sheets

METAL CONTAINER CAPABLE OF WITHSTANDING INTERNAL OVER PRESSURE

BACKGROUND OF THE INVENTION

The invention relates to a metal container which is capable of withstanding internal overpressure and whose hollow vessel containing the contents is composed of an essentially cylindrical wall and two outwardly curved end walls, wherein at least one of the end walls has a bulge which protrudes as a cup-shaped bottom from the curved end wall, wherein at least one container connecting pipe is provided which is preferably seated in the bulge or cup-shaped wall, and wherein an intended breaking point formed as a notch at the outer surface is integrated in at least one of the end walls.

DESCRIPTION OF THE RELATED ART

Containers of this type are primarily used for the transport and storage of liquids and are predominantly utilized in the beverage industry for containing beer or alcohol-free beverages. They are intended for operating pressures which are usually between 0 and 7 bars overpressure. These containers are either equipped only with standing rings or gripping rings of metal, of synthetic material or also of rubber, or they are provided with a complete shell of these materials which then forms the standing ring and gripping ring and additionally surrounds the cylindrical wall of the container.

The containers of this type are increasingly equipped with an integrated overpressure protection which in certain cases of application is even required by regulations.

The overpressure protection has the purpose of preventing the internal pressure of the container from rising to very high values up to bursting when the container is incorrectly handled or when pressure reduction devices are incorrectly operated or fail to operate. In other words, when the internal pressure of the container reaches a defined value below the maximum bursting pressure of the container, the existing overpressure is to be discharged safely by an automatic opening of the intended breaking point in the wall of the container. In accordance with the prior art, this intended breaking point is provided as a defined reduction of the thickness of the container wall at various points of the container; preferably, the reduced thickness points have the form of a notch, as already mentioned above.

When producing this intended breaking point in the form of a notch, it must be ensured that the remaining thickness of the container wall is selected with a dimension that is technically sound, while not reducing the long-term strength of the container under operating conditions.

For the above reasons, the previously known solutions still have a relatively high opening pressure of the intended breaking point in relation to the bursting pressure of the container without intended breaking point.

In accordance with DE-OS 35 33 406, a container of this type has an intended breaking point in the cup-shaped bottom, wherein the opening pressure is approximately 50 to 70% of the bursting pressure of a container without intended breaking point. As a general requirement, the technically controllable minimum residual thickness of the container wall without impairing the long-term strength of the container during operation is approximately 25 to 30% of the normal wall thickness of the surrounding wall.

In a variation of this embodiment used millions of times, DE-OS 35 33 406 starts from a container which has an inner shell of metal and a casing of synthetic material which surrounds and is fixedly connected to the inner shell, wherein the intended breaking point serves its function even when the casing is provided. In this case, the influence of the casing of synthetic material which increases the response pressure of the intended breaking point is 50 to 70% of the bursting pressure of the container and, thus, is relatively small, especially in view of the fact that the thickness of the casing is as small as possible in the area of the cup-shaped bottom in order to save material costs. The casing of synthetic material provides the advantage that a corrosion influence (crevice corrosion) on the intended breaking point mechanically produced in the form of a notch and also mechanical damage are prevented, and that undesired manipulations of the externally not visible intended breaking point are practically excluded.

In accordance with DE-OS 37 37 977, another container is known in which an intended breaking point is supposed to discharge the impermissible overpressure, wherein the intended breaking point is arranged in the transition area between the curvature of an end wall and the cylindrical container wall, i.e., in the area of the bottom rim. The response pressure of the intended breaking point is still at approximately 60 to 70% of the bursting pressure of a container without an intended breaking point, when the minimum remaining thickness in the area of the notch forming the intended breaking point still is to have a technically controllable dimension of at least 20 to 25% of the initial wall thickness and the intended breaking point is to additionally have a sufficient strength with respect to alternating pressure for the normal operating pressures of the container. However, DE-OS 37 37 977 generally starts from a container without casing, i.e., from an intended breaking point which is not at all covered. However, when the intended breaking point according to this embodiment is covered by a casing, for example, in the form of a casing of synthetic material or by a standing ring or gripping ring of rubber which is integrally formed or vulcanized, the response pressure increases by approximately 5 to 10 bars depending on the type of cover. Of course, this pressure increase is directly dependent on the stability or the thickness of the cover.

In containers with integrated overpressure protection in the form of an intended breaking point, there is a certain residual risk that the container can rupture as a result of a material defect or production defect before the intended breaking point has assumed its safety function. This residual risk increases in direct dependence on the ratio of the response pressure of the intended breaking point relative to the nominal bursting pressure of the container. In other words, the existing residual risk increases with increasing response pressure of the intended breaking point.

In the previously known configurations of intended breaking points, the minimum residual thickness of the wall in the area of the notch is already so small that it cannot be further reduced for reasons of technical control of the manufacture and the long-term strength of the container under operating conditions. A further reduction of the residual thickness is also not possible because of the danger of failure resulting from external mechanical damage.

SUMMARY OF THE INVENTION

Therefore, the invention is based on the object, for further reducing the above-described risk and for certain uses of the container, to provide an intended breaking point which is integrated in an end wall and is constructed as a notch, wherein the response pressure is approximately 25% of the nominal bursting pressure of a container without intended breaking point, wherein the intended breaking point still has a technically controllable residual metal thickness of about 25% of the thickness of the surrounding metal wall, and wherein the maximum bursting pressure is adhered to even when the intended breaking point is covered by a casing or by standing rings or gripping rings of synthetic material or rubber.

In accordance with the invention, this complex object is basically met by providing the notch of the intended breaking point with varying depths, wherein the maximum depth of the notch is provided in that area of the end wall which is subjected to the greatest deformation when a defined internal pressure exceeding the permissible operating pressure acts on the intended breaking point.

It has been found particularly useful, in accordance with the invention, if the maximum depth of the notch is located in the area of the maximum extension of the end wall and the location of the notch is arranged transversely of the direction of the maximum extension of the end wall.

This provides the significant advantage that the opening pressure of the intended breaking point is a minimum at a given residual thickness. Experiments have shown that the maximum extension of the end wall occurs in the spherical surface of the end wall in the immediate vicinity to the bulge of the cup-shaped bottom, and that the maximum extension of the end wall at this location occurs in tangential direction relative to a concentric circle on the spherical surface of the end wall.

Of course, the intended breaking point can be arranged in the upper end wall as well as in the lower end wall. The response pressure is independent of whether the intended breaking point is arranged in the top end wall or the bottom end wall. However, it may be an advantage to arrange the intended breaking point in the top end wall because, in the case the container is in a standing position, the pressure decrease in the case of a response of the intended breaking point takes place more quickly through the pressurized gas which usually is at the top than by discharging the liquid contained in the container through an intended breaking point in the bottom end wall.

Tests with intended breaking points of the type according to the invention have shown that in both cases there is no endangerment of persons due to discharged medium and/or due to sudden movements of the container.

When the invention is used, for example, in a beverage container having a wall thickness of metal in the area of the intended breaking point of 0.8 to 0.9 mm, the intended breaking point having a residual thickness of 0.2 mm in the area of the notch and with a casing of synthetic material opens at an overpressure of at most 25 bars, wherein this container has a bursting pressure of 95 to 100 bars without intended breaking point.

It has been found that, in the arrangement and configuration of the intended breaking point according to the invention, the casing is also subjected to a maximum extension at this location and, thus, has the smallest influence on the increase of the opening pressure of the intended breaking point at this location. This effect is intensified by the fact that the casing of the end wall has the smallest wall thickness in this particular area.

The intended breaking point in the form of a notch is preferably produced by a chip-removing rotating tool. However, the removal of material can also be achieved by means of, for example, a laser device. Preferably, the notch describing a full circle has opposite portions with different depths.

Depending on the initial thickness of the end wall of metal, the surface area entirely or partially surrounded by the notch preferably has a diameter of 15 to 25 mm. The notches produced by a laser operation or in another manner may also have other geometric shapes. For example, they may describe a partial circle of 240 to 300° circumference and may be formed of a notch with uniform depths. However, in all cases, the notch should have a shape which, after opening the intended breaking point, does not have the tendency of conducting the fracture in the bottom of the notch through the edge of the notch into the end wall surface. This prevents the danger of rupture of the end wall.

The cup-shaped bottom of one or both end walls is usually formed by a bulge arranged centrally in the curvature of the end wall. In other words, the notch forming the intended breaking point having the maximum depth is also located remote from the center of the curvature of the end wall by approximately the radius of the bulge.

However, it is certainly conceivable—in a special case—to arrange the bulge of the end wall or of both end walls eccentrically on the curvature of the end wall, so that the adjacent notch of the intended breaking point is located with its maximum depth more or less far away from the center of the curvature of the end wall.

BRIEF DESCRIPTION OF THE DRAWINGS

An example of the configuration of the subject matter of the invention will be described in more detail in the following with the aid of the drawings. In the drawing.

DESCRIPTION OF THE PREFERRED EMBODIMENT

Figure 1:
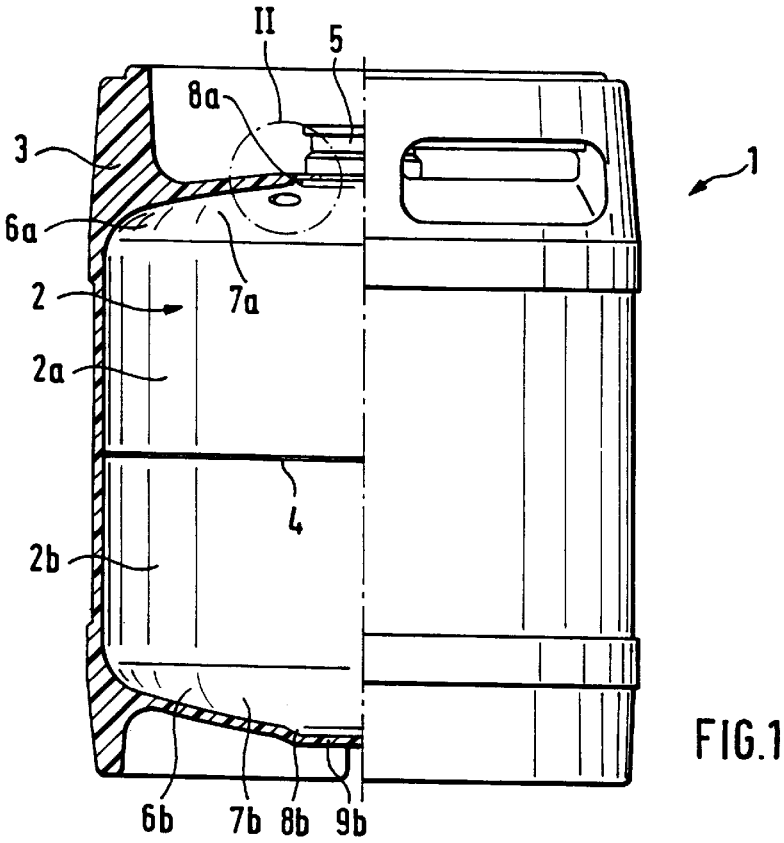
FIG. 1 is a view, partially in section, of a metal container capable of withstanding overpressure constructed as a beverage container which is completely surrounded by a casing.

FIG. 1 illustrates a container capable of withstanding internal overpressure and constructed as a beverage container 1. The beverage container 1 is composed of an inner container of metal having a thin wall and completely surrounded by a casing 3 of a partially foamed synthetic material.

The inner container 2 is composed of two deep-drawn half shells 2*a* and 2*b* which are connected to each other through a welding seam 4, and of a connecting pipe 5. The two half shells 2*a* and 2*b* have an upper end wall 6*a* or a lower end wall 6*b*, respectively, which is composed of a partial spherical surface 7*a* or 7*b*, respectively, and a bulge arranged centrally in the spherical surface and constructed as a cup-shaped wall 8*a* or 8*b*, respectively. The bulges 8*a* and 8*b* project outwardly out of the envelope of the partial spherical surfaces 7*a*and 7*b* and usually have a central plane surface 9*a* or 9*b*, respectively. The connecting pipe 5 is inserted in the surface 9*a* of the bulge 8*a* in the upper end wall 6*a*.

Figure 2:
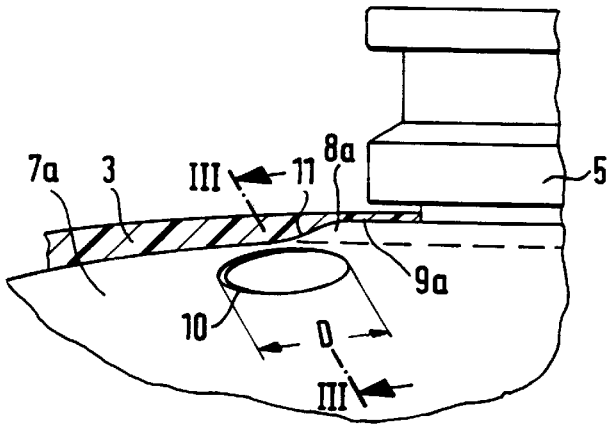
FIG. 2 is a sectional view, on a larger scale, of a detail designated by II in FIG. 1.

FIG. 2 shows that an intended breaking point constructed as an annular notch 10 is arranged in the partial spherical surface 7*a* of the upper end wall 6*a* near the transition 11 to the upper bulge 8*a*. At this location is the area of the greatest extension of the end wall 6*a* under the influence of an internal pressure of the inner container 2. When the container 1 is subjected to an internal pressure which is significantly above the permissible operating pressure, a deformation of the bulges 8*a* and 8*b* in the form of cup-shaped walls takes place without a significant increase of the material tension in the surface areas 9*a* and 9*b*. This is because initially the material supply contained in the bulges of these cup-shaped walls 8*a* and 8*b* is used up until the point in time at which, as a result of the tension, the surface areas 9*a* and 9*b* of the cup-shaped walls 8*a* and 8*b* also have assumed the spherical shape of the surrounding partial spherical surfaces 7*a* and 7*b*.

Figure 4:
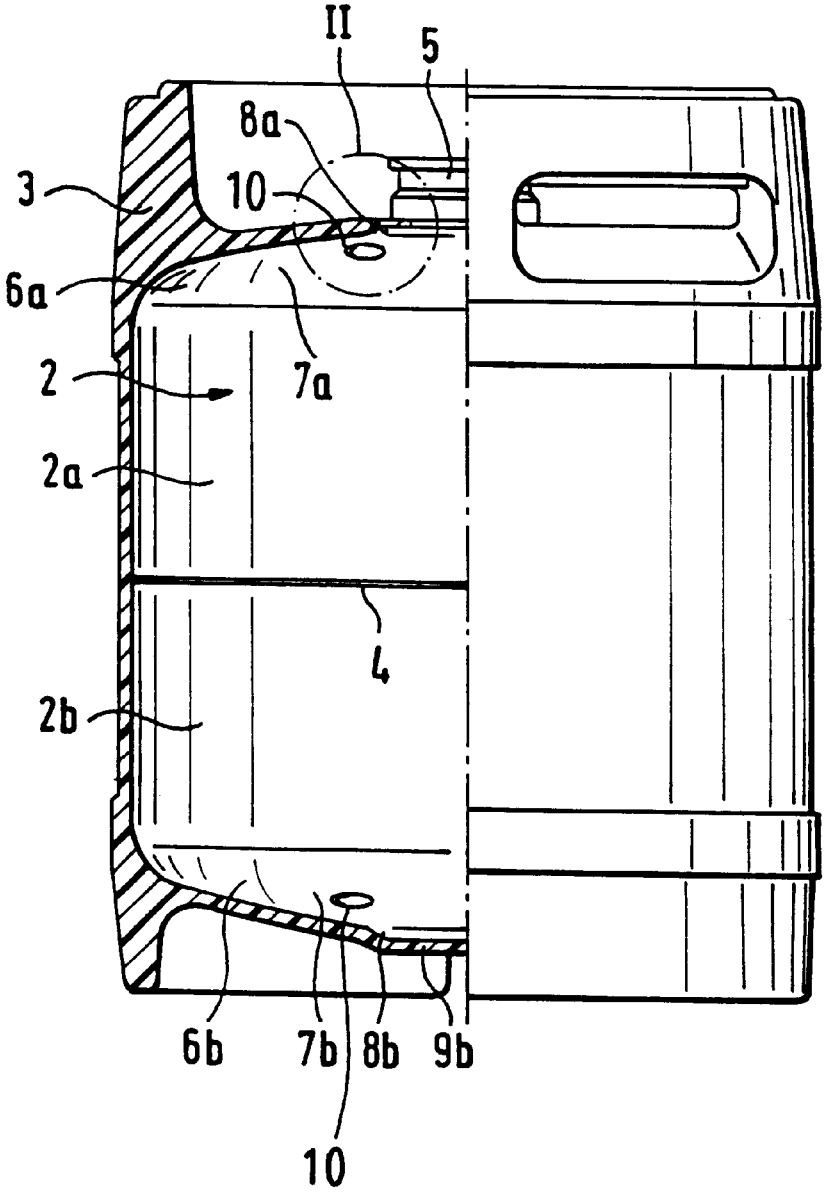
FIG. 4 is a view similar to FIG. 1, showing another embodiment of the present invention.

As shown in FIG. 4, it is also possible to provide annular notch 10 both in the upper end wall 6*a* and the lower end wall 6*b*.

At this point in time, the partial spherical surface 7*a* has reached a maximum extension in the vicinity of the transition area 11 to the cup-shaped wall 8*a* and, thus, the tension has increased to such an extent that an opening of the intended breaking point in the area 12 of the smallest residual thickness of the notch has already occurred or will occur when the pressure further increases.

As soon as the notch 10 has opened at its deepest location 12 with a residual thickness S' of approximately 25% of the initial thickness S of the metal wall surface 13 (see FIG. 3), a slight pressure increase has the result that the portion of the casing 3 which has a relatively small wall thickness and which covers the notch 10 also ruptures. Consequently, the completely open intended breaking point can now safely discharge the overpressure.

Figure 3:
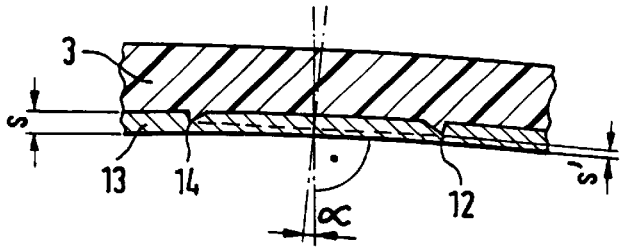
FIG. 3 is a sectional view, on an even larger scale, taken along sectional line III—III in FIG. 2.

As shown in FIG. 3, the deepest location of the notch 10 and the highest location 14 are located diametrically opposite each other. When the notch 10 is produced by a rotating tool, it has been found advantageous to set up the tool in such a way that, in the case of a notch diameter D of between 15 and 25 mm, the deviation $\alpha$ of the tool axis from the perpendicular relative to the wall surface 13 is approximately 1.0 to 1.5°.

For a correct operation of the overpressure protection or intended breaking point it is important that the notch forming the intended breaking point extends in the area of the maximum extension of the end wall 6*a* transversely of the direction of this maximum extension, so that the notch ruptures at the location of its maximum depth 12 when the defined inner overpressure of the container 1 is exceeded.

It has been found useful if the notch 10 has a circular shape, as it is illustrated in FIG. 2 of the drawing, and that the notch 10 has a maximum depth 12 of approximately 75% and a minimum depth 14 of approximately 25% of the normal thickness S of the surrounding wall surface 13.

When the notch 10 of the intended breaking point is produced, for example, by a laser operation, as a portion of a circle with a circumferential angle of between 240 and 300°, it is important that the notch 10 is placed on the partial spherical surface 7*a* or 7*b* of the end wall 6*a* or 6*b*, respectively, in such a way that the bisecting line of the circumferential angle forms a tangent on a concentric circle on the partial spherical surface 7*a* or 7*b* of the end wall 6*a* or 6*b*, respectively. Especially in this case, the notch 10 may also have a uniform depth.

In a deviation from the embodiment shown in the drawing, it may also be used for special cases to arrange, for example, the bulge 8*b* in the lower end wall 6*b* of the inner container 2 not concentrically in the partial spherical surface 7*b*, but rather out of center relative to the curvature of the wall. Of course, the notch 10 serving as overpressure protection or intended breaking point is then located with its deepest location 12 more or less far from the center of the respective partial spherical surface 7*a* at the curvature of the end wall 6*b*.

What is claimed is:

1. A container of metal capable of withstanding internal overpressure, the container comprising a hollow vessel for containing contents having an essentially cylindrical side wall and two outwardly curved end walls formed as partial spherical surfaces, at least one of the curved end walls having a central bulge protruding as a cup-shaped bottom from the curved end wall, a container connecting pipe being mounted on the central bulge of the at least one curved end wall, an intended breaking point being integrated in the at least one end wall, the intended breaking point being an annular notch formed in an outer side of the at least one end wall, the notch having varying depths including a maximum depth and a minimum depth, wherein the notch has a geometric configuration whereby the minimum depth is located diametrically opposite the maximum depth, the notch being located in the at least one end wall adjacent the central bulge thereof.

2. The container according to claim 1, wherein the maximum depth of the notch is located immediately adjacent a transition between the partial spherical surface and the bulge forming the cup-shaped bottom.

3. The container according to claim 1, wherein the notch has a circular shape and the maximum depth is approximately 75% and the minimum depth is approximately 25% of a surrounding wall surface.

4. The container according to claim 1, wherein the bulge is arranged concentrically in the partial spherical surface of the end wall.

* * * * *